US011859940B2

(12) United States Patent
Lort

(10) Patent No.: US 11,859,940 B2
(45) Date of Patent: Jan. 2, 2024

(54) ADJUSTABLE HOP-UP DEVICE FOR AIRSOFT GUN

(71) Applicant: Rich Lort, Kingsport, TN (US)

(72) Inventor: Rich Lort, Kingsport, TN (US)

(73) Assignee: Disruptive Design LLC, Kingsport, TN (US)

( * ) Notice: Subject to any disclaimer, the term of this patent is extended or adjusted under 35 U.S.C. 154(b) by 0 days.

(21) Appl. No.: 17/356,963

(22) Filed: Jun. 24, 2021

(65) Prior Publication Data

US 2022/0003518 A1 Jan. 6, 2022

Related U.S. Application Data

(60) Provisional application No. 63/043,432, filed on Jun. 24, 2020.

(51) Int. Cl.

| | |
|---|---|
| ***F41B 11/70*** | (2013.01) |
| *F41B 7/00* | (2006.01) |
| *F41B 11/50* | (2013.01) |

(52) U.S. Cl.

CPC ..... *F41B 11/70* (2013.01); *F41B 7/006* (2013.01); *F41B 11/50* (2013.01)

(58) Field of Classification Search

CPC ..... F41B 11/70; F41B 11/89; F41B 11/50; F41B 11/00; F41B 7/006; F41B 7/08

USPC ..... 446/176

See application file for complete search history.

(56) References Cited

U.S. PATENT DOCUMENTS

| | | | | |
|---|---|---|---|---|
| 3,009,703 | A * | 11/1961 | Jentsch | F41B 11/50 221/175 |
| 3,662,729 | A * | 5/1972 | Henderson | A63B 69/409 124/81 |
| 3,765,396 | A * | 10/1973 | Kienholz | F41B 11/50 124/53.5 |
| 4,770,153 | A | 9/1988 | Edelman | |
| 4,830,056 | A | 5/1989 | Chamberlain | |
| 5,613,483 | A | 3/1997 | Lukas | |
| 5,778,868 | A | 7/1998 | Shepherd | |
| 5,878,736 | A | 3/1999 | Lotuaco et al. | |
| 6,276,353 | B1 | 8/2001 | Briggs et al. | |
| 6,470,872 | B1 | 10/2002 | Tiberius et al. | |
| 6,601,780 | B1 | 8/2003 | Sheng | |

(Continued)

OTHER PUBLICATIONS

Tech Tips Hopup Buckings Explained/ Fox Airsoft (Year: 2020).*

*Primary Examiner* — John E Simms, Jr.

(74) *Attorney, Agent, or Firm* — Blanchard Horton PLLC

(57) ABSTRACT

A hop-up device for an airsoft gun allows a user to adjust the tension applied to a BB during the chambering of the BB in the airsoft gun. The hop-up device has an adjustable tension adjustment sleeve configured to constrict a desired amount around the BB. The tension adjustment sleeve provides tension on the BB when the air nozzle is seating, or chambering, the BB in the bucking lips of a rubber bucking prior to firing. By adjusting the tension adjustment sleeve, the user can increase or decrease the bucking lip tension on the BB to reduce or essentially eliminate the adverse effects from manufacturing tolerances, wear, and the like. These adverse effects can cause double feeding of the BBs, jamming, inconsistent firing, slow firing, midcap syndrome (the feed spring in the magazine is too strong and forces BBs against the air nozzle with excessive force), and the like.

5 Claims, 5 Drawing Sheets

(56) References Cited

U.S. PATENT DOCUMENTS

| | | | | |
|---|---|---|---|---|
| 6,925,997 | B2 | 8/2005 | Sheng | |
| 7,121,273 | B2 | 10/2006 | Styles | |
| 7,229,796 | B2 | 6/2007 | Deangelis et al. | |
| 7,299,796 | B2 | 11/2007 | Kirwan | |
| 7,334,598 | B1 | 2/2008 | Hollars | |
| 7,509,953 | B2 | 3/2009 | Wood | |
| 7,527,049 | B2 | 5/2009 | Sheng | |
| 7,533,664 | B2 | 5/2009 | Carnall | |
| 7,603,997 | B2 | 10/2009 | Hensel et al. | |
| 7,624,727 | B2 | 12/2009 | Campo | |
| 7,640,925 | B2 | 1/2010 | Jones | |
| 7,640,926 | B2 | 1/2010 | Jones | |
| 7,712,464 | B2 | 5/2010 | Lian | |
| 7,730,881 | B1 | 6/2010 | Pedicini et al. | |
| 7,735,479 | B1 | 6/2010 | Quinn et al. | |
| 7,762,247 | B2 | 7/2010 | Evans | |
| 7,770,572 | B2 | 8/2010 | Lian | |
| 7,861,703 | B2 | 1/2011 | Liao | |
| 7,921,839 | B2 | 4/2011 | Wood | |
| 7,931,018 | B1 | 4/2011 | Lai | |
| 7,997,260 | B2 | 8/2011 | Kaakkola et al. | |
| 8,033,276 | B1 | 10/2011 | Gabrel | |
| 8,104,463 | B2 | 1/2012 | Wood | |
| 8,201,547 | B2 | 6/2012 | Wood | |
| 8,267,077 | B2 | 9/2012 | Kaakkola et al. | |
| 8,272,373 | B2 | 9/2012 | Masse | |
| 8,336,532 | B2 | 12/2012 | Masse | |
| 8,453,633 | B2 | 6/2013 | Tsai | |
| 8,485,172 | B2 | 7/2013 | Tseng | |
| 8,671,928 | B2 | 3/2014 | Hague et al. | |
| 9,033,306 | B2 | 5/2015 | Kunau | |
| 9,080,832 | B2 | 7/2015 | Brahler et al. | |
| 9,297,606 | B2 | 3/2016 | Harvey et al. | |
| 9,903,684 | B2 | 2/2018 | Lort | |
| 10,295,302 | B2 | 5/2019 | Lort | |
| 10,598,461 | B2 | 3/2020 | Lort | |
| 2002/0096164 | A1 | 7/2002 | Perrone | |
| 2003/0005918 | A1 | 1/2003 | Jones | |
| 2003/0182838 | A1* | 10/2003 | Kessler | F41A 21/00 42/79 |
| 2004/0200115 | A1 | 10/2004 | Monks et al. | |
| 2005/0011507 | A1 | 1/2005 | Webb | |
| 2005/0178877 | A1* | 8/2005 | Marsac | F41B 11/57 244/3.21 |
| 2006/0027223 | A1 | 2/2006 | Vasel et al. | |
| 2006/0090739 | A1 | 5/2006 | Jones | |
| 2007/0119988 | A1 | 5/2007 | Sheng | |
| 2007/0125351 | A1* | 6/2007 | Campo | F41B 11/62 124/56 |
| 2008/0127960 | A1 | 6/2008 | Gan | |
| 2009/0241931 | A1 | 10/2009 | Masse | |
| 2010/0154767 | A1 | 6/2010 | Masse | |
| 2011/0120437 | A1 | 5/2011 | Tippmann, Jr. et al. | |
| 2012/0216786 | A1 | 8/2012 | Hadley et al. | |
| 2012/0272941 | A1* | 11/2012 | Hu | F41A 21/12 124/83 |
| 2013/0247893 | A1 | 9/2013 | Yang | |
| 2015/0020789 | A1* | 1/2015 | Tseng | F41B 11/72 124/73 |
| 2015/0059726 | A1* | 3/2015 | Harvey | F41B 11/62 124/73 |
| 2015/0300770 | A1 | 10/2015 | Tseng | |
| 2016/0033230 | A1 | 2/2016 | Lort | |
| 2016/0116244 | A1* | 4/2016 | Zou | F41B 11/00 124/83 |
| 2016/0216059 | A1* | 7/2016 | Travis | F41B 11/62 |
| 2016/0348999 | A1* | 12/2016 | Raymond, Jr. | F41B 11/89 |
| 2017/0299321 | A1 | 10/2017 | Lort | |
| 2017/0299322 | A1 | 10/2017 | Lort | |
| 2018/0180377 | A1 | 6/2018 | Lort | |
| 2022/0082351 | A1* | 3/2022 | Liao | F41B 11/89 |

* cited by examiner

ADJUSTABLE HOP-UP DEVICE FOR AIRSOFT GUN

REFERENCE TO RELATED APPLICATIONS

This application claims the benefit of U.S. Provisional Application No. 63/043,432 entitled "Adjustable Hop-up Device for Airsoft Gun" filed Jun. 24, 2020 which is incorporated by reference in its entirety.

BACKGROUND

Hop-up systems are well known in the field of airsoft guns ("hop" is short for "high operation power"). Hop-ups work to provide a backspin to airsoft BBs to increase the distance that the BBs obtain after leaving the barrel. The distance is increased via the Magnus effect, which is caused by the hop-up applying the backspin to the BB before it leaves the barrel. Without the backspin, the very light BBs would begin to lose velocity very quickly after leaving the barrel, and thus the distance over which the BBs travel would be very short. Without a hop-up, a BB may travel between about 20 ft to 30 ft. With a hop-up, a BB may travel between about 75 ft to 100 ft.

Hop-ups operate through a rubber bucking provided to a proximal end of the airsoft gun barrel. The hop-up applies the backspin to the BB by a nub that presses down from a top of the rubber bucking and through an opening in the barrel to contact the BB upon firing. As the BB passes the nub on the way out of the barrel, the friction of the contact between the nub and the top of the BB causes the BB to backspin. The amount by which the nub protrudes through the opening into the barrel is adjustable, typically by an adjustable hop arm or other such mechanism provided at the top of the device or system. By using the hop arm to adjust the amount of contact between the nub and the BB, the amount of BB backspin can be adjusted to a desired level.

Most all airsoft guns are equipped with such a hop-up device or system, with the conventional configuration of an air nozzle that is provided behind the proximal end of the rubber bucking to seat the BB in firing position in the tapered end of the rubber bucking. The tapered end of the rubber bucking or bucking lip generally has an entrance aperture slightly larger than a BB so as to allow a BB to pass into the tapered end to be held in place before firing, and to allow the BB to move on through the rubber bucking when fired. A critical element of performance of the hop-up is the amount of force used or required to load the BB into position for firing, the bucking lip tension. When exiting the magazine into the air nozzle area to be chambered, the BB is pushed into the tapered lips of the rubber bucking to seal against the air delivery engine. If too much force is required to seat the BB in the tapered end of the bucking, the gun may jam. If too little force is required, the BB may simply pass through and cause the magazine to double feed. If the hop-up is set correctly so the proper amount of force is used, there will be precise placement of the BB in the tapered end of the bucking.

One limiting factor affecting the performance of the conventional hop-up is the manufacturing tolerances of the device or system. The tapered lips of the rubber bucking need to form a precise aperture, and need a certain level of flexibility, to perform correctly. Minor deviations in manufacture can have significant effect on performance, causing jamming, double feeding, and the like. These minor deviations may be within the design parameters of the manufacturing equipment, so reducing them may not be feasible.

These minor deviations also may affect hop-up consistency in operation from one airsoft gun to another.

Another limiting factor can be the wear of the rubber bucking. If the rubber bucking becomes too worn, the tapered end may not be strong enough to hold the BB in place, or chambered, which may allow the BB to slide through before firing and cause a double feed.

As can be seen from the above description, there is an ongoing need for simple and efficient hop-ups for airsoft guns that eliminate the effect from minor deviations in manufacturing tolerances and from wear. The devices and systems of the present invention overcome at least one of the disadvantages associated with conventional devices and systems. The present invention avoids or ameliorates at least some of the disadvantages of conventional devices and systems.

SUMMARY

In one aspect, the invention provides a hop-up system for an airsoft gun that includes a rubber bucking configured for a BB to travel therethrough. A mechanism adjusts the engagement of a nub into a top portion of the rubber bucking to place a backspin on the BB traveling therethrough. A tension adjustment sleeve is provided adjacent a proximal end of the rubber bucking and is configured to apply a desired tension on a BB being positioned to enter the rubber bucking.

In another aspect of the invention, there is a hop-up system for an airsoft gun having a rubber bucking that forms a hollow core with a diameter for a BB to travel through. The rubber bucking has a bucking lip. A mechanism for adjusts the engagement of a hop nub through a top portion of the rubber bucking. The hop nub is disposed to engage the top of the BB when traveling through the hollow core. A tension adjustment sleeve is axially situated adjacent to the bucking lip. The tension adjustment sleeve is operatively disposed to apply a desired tension on a BB when the BB is loaded against the bucking lip. A tension adjustment screw is transitionally disposed adjacent to the tension adjustment sleeve. The tension adjustment screw transitions between at least two axial locations. The tension adjustment screw applies a pressure to the tension adjustment sleeve at each axial location. The pressure is different at each axial location. The tension adjustment sleeve applies a different desired tension to the BB when the tension adjustment screw is at a different axial location.

In another aspect of the invention, there is an airsoft gun having a hop-up device disposed in the lower receiver. The hop-up device adjusts the tension applied to a BB during the chambering of the BB in the airsoft gun. A barrel has a proximal end inserted into to the hop-up device. The proximal end of the barrel disposed in the lower receiver. An airsoft engine is connected to the hop-up device opposite the barrel. A stock is connected to the lower receiver. The stock houses the airsoft engine. An upper receiver is mounted on the lower receiver. The upper receiver has a rail. The barrel extends through the rail. A magazine is connected to the lower receiver. The magazine feeds BBs to the hop-up device.

Other systems, methods, features and advantages of the invention will be, or will become, apparent to one with skill in the art upon examination of the following figures and detailed description. It is intended that all such additional systems, methods, features, and advantages be included within this description, be within the scope of the invention, and be protected by the claims that follow. The scope of the present invention is defined solely by the appended claims and is not affected by the statements within this summary.

BRIEF DESCRIPTION OF THE FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

A hop-up device or system for an airsoft gun has been developed that allows a user to adjust the tension applied to a BB during the chambering of the BB in the airsoft gun. The hop-up device or system has an adjustable tension adjustment sleeve configured to constrict a desired amount around the BB. The tension adjustment sleeve provides tension on the BB when the air nozzle is seating, or chambering, the BB in the bucking lips of a rubber bucking prior to firing. By adjusting the tension adjustment sleeve, the user can increase or decrease the bucking lip tension on the BB to reduce or essentially eliminate the adverse effects from manufacturing tolerances, wear, and the like. These adverse effects can cause double feeding of the BBs, jamming, inconsistent firing, slow firing, midcap syndrome (the feed spring in the magazine is too strong and forces BBs against the air nozzle with excessive force), and the like.

Figure 1:
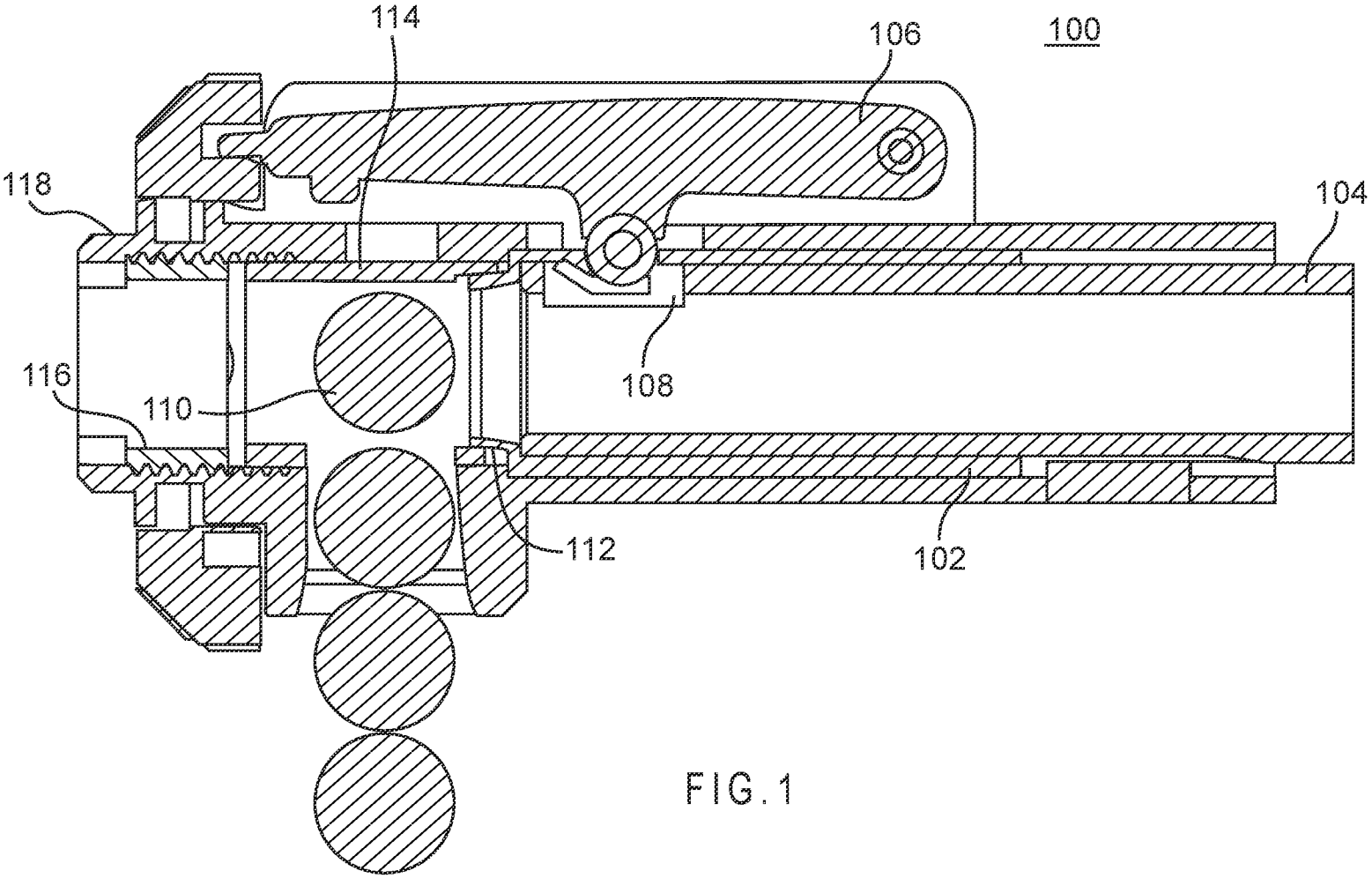
FIG. 1 represents a cross-section of a hop-up device or system that allows a user to adjust the tension applied to a BB during the chambering of the BB in the airsoft gun.
Figure 2:
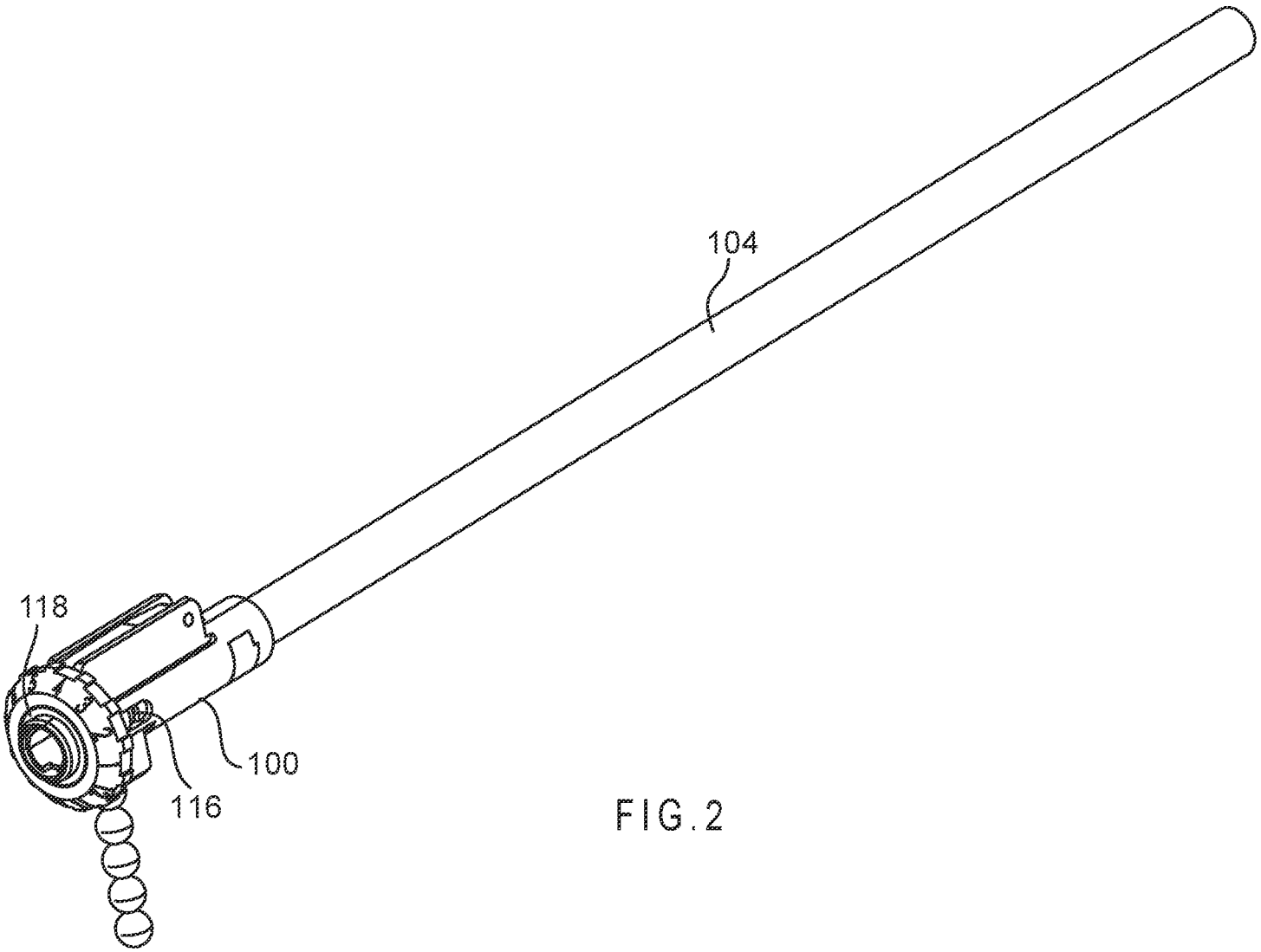
FIG. 2 represents a proximal view of a barrel with the hop-up device or system showing the threaded dial.
Figure 3:
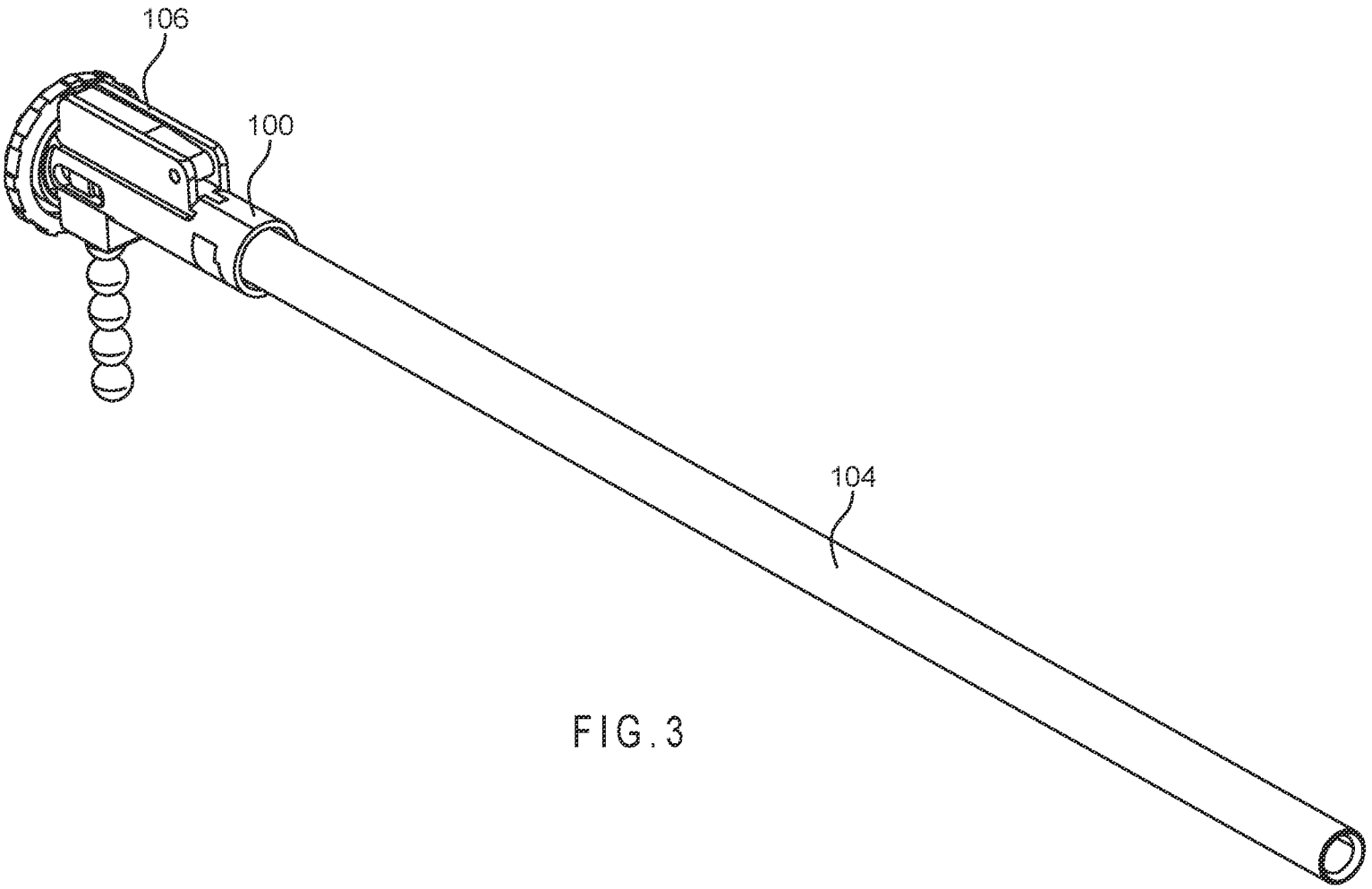
FIG. 3 represents a distal view of a barrel with the hop-up device or system showing the threaded dial.
Figure 4:
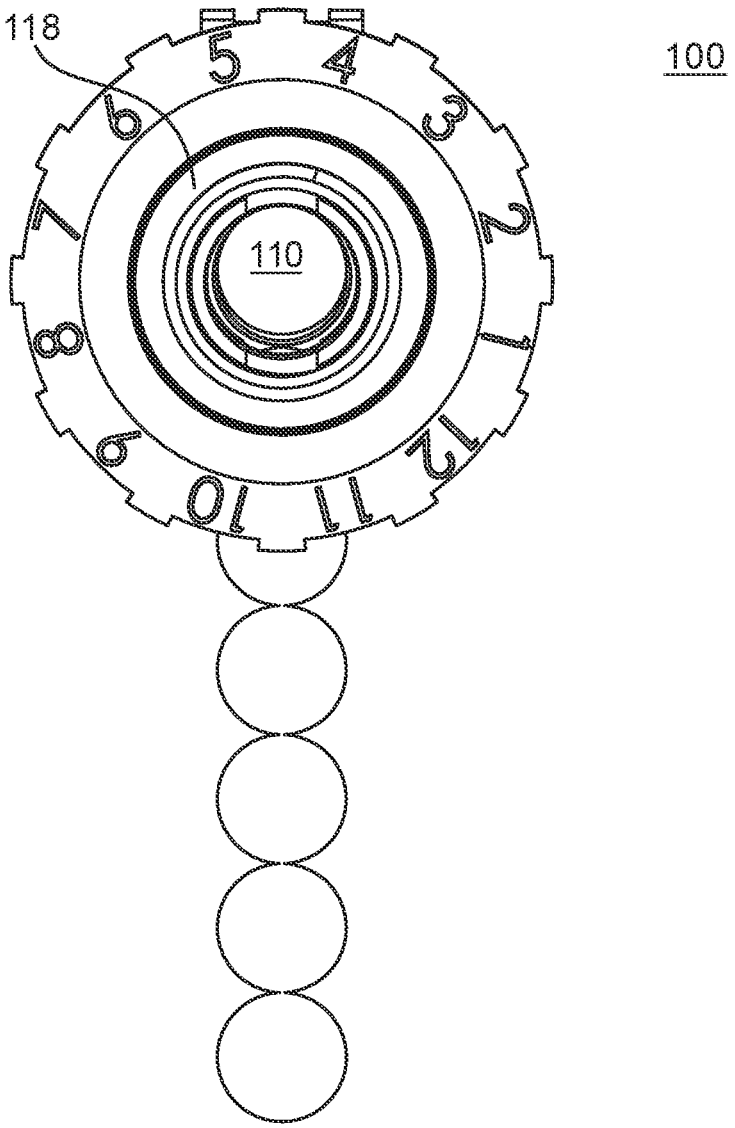
FIG. 4 represents an axial view of the hop-up device or system showing the threaded dial.
Figure 5:
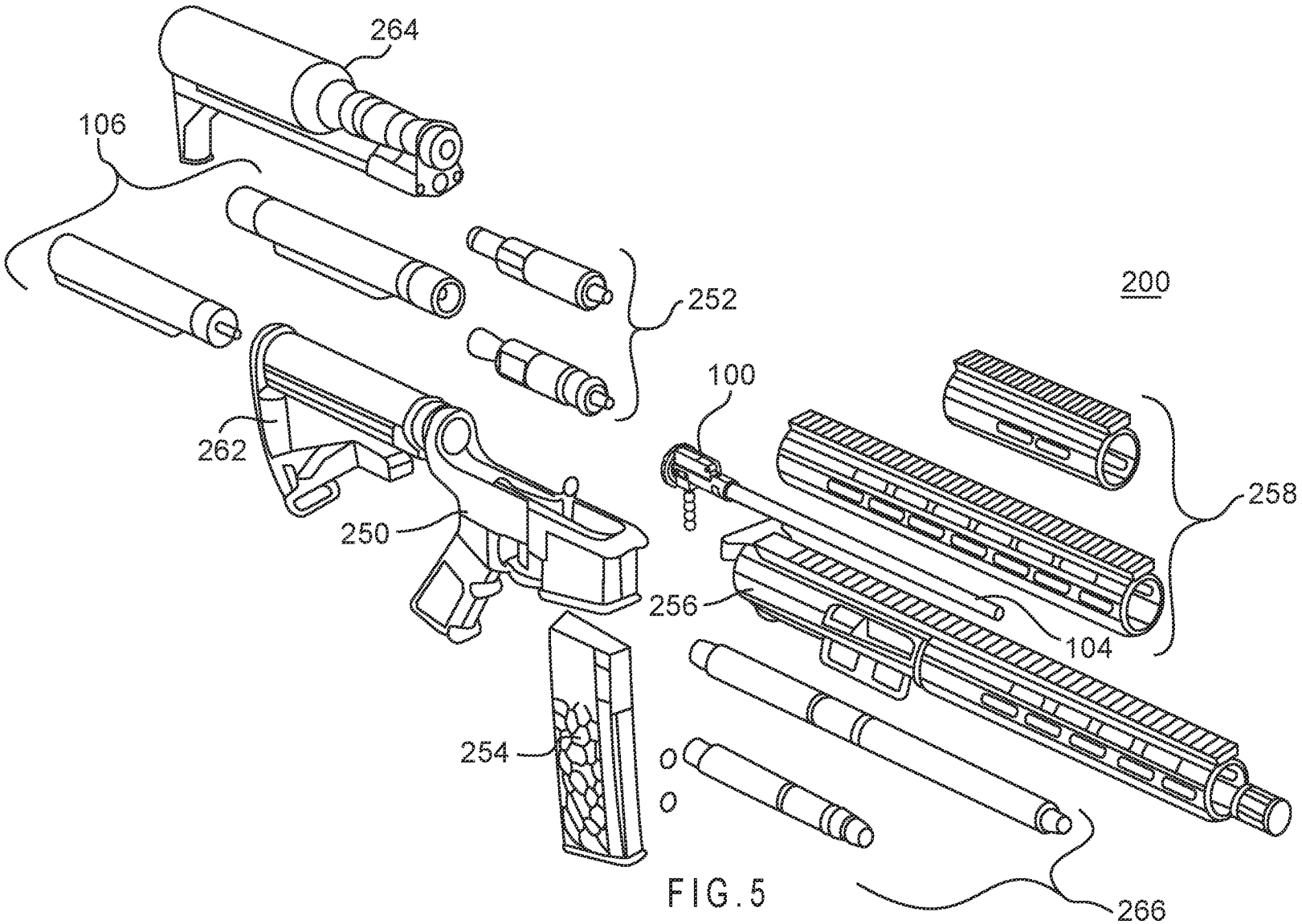
FIG. 5 represents a disassembled view an airsoft gun system with the hop-up device or system that allows the assembly of one airsoft gun having one of three optional configurations.

FIG. 1 represents a cross-section of a hop-up device or system 100 that allows a user to adjust the tension applied to a BB during the chambering of the BB in the airsoft gun. FIG. 2 represents a proximal view of a barrel 104 with the hop-up device or system 100 showing the threaded dial 118. FIG. 3 represents a distal view of a barrel 104 with the hop-up device or system 100 showing the threaded dial 118. FIG. 4 represents an axial view of the hop-up device or system 100 showing the threaded dial 118. FIG. 5 represents a disassembled view an airsoft gun system 200 with the hop-up device or system 100 that allows the assembly of one airsoft gun having one of three optional configurations.

In FIG. 1, the hop-up device or system 100 includes a rubber bucking 102 mounted on a proximal end of a barrel 104, An adjustable hop arm 106 is disposed longitudinally on a top of the hop-up device or system 100 to apply a desired force downward on a hop nub 108 that extends into the barrel 102 to apply backspin to a BB 110 when the BB 110 is fired through the barrel. While the hop arm 106 is illustrated, the hop-up device or system 100 may use other mechanisms for adjusting the engagement of the hop nub 108. While hob nub 108 is illustrated with particular configuration, other configurations of a hob nub may be used. As with conventional hop-ups, the rubber bucking 102 has a tapered proximal end or a bucking lip 112 in which the BB 110 will be seated by the air nozzle (see FIG. 5) of the airsoft gun (see FIG. 5) in order to chamber the BB 110 that is loaded from the magazine (see FIG. 5). The rubber bucking 102 forms a hollow core having a diameter for the BB 110 to pass through to the barrel 102.

The hop-up device or system 100 is provided with a tension adjustment sleeve 114 axially situated adjacent to the tapered end or bucking lip 112 of the rubber bucking 102. A tension adjustment screw 116 is operatively connected to the opposite end of the tension adjustment sleeve 114. The tension adjustment screw 116 has multiple axial locations to change the pressure applied to the tension adjustment sleeve 114. The tension adjustment screw 116 applies a different pressure to the tension adjustment sleeve 114 at each axial location. There are least two axial locations of the tension adjustment screw 116 adjacent to the tension adjustment sleeve 114; however, there may be numerous if not essentially infinite axial locations, but preferably there are between 10 through 15 axial locations, and more preferably 12 axial locations. The tension adjustment screw 116 is thus configured to move the tension adjustment sleeve 114 along the axial locations toward (tighten) and away from (untighten) the tapered end or bucking lip 112. When tightened, the tension adjustment screw 116 increases the pressure applied to the tension adjustment sleeve 114. When untightened, the tension adjustment screw 116 decreases the pressure applied to the tension adjustment sleeve 114. When the pressure against the tension adjustment sleeve 114 increases or decreases, the tension adjustment sleeve 114 is compressed or decompresses accordingly against the bucking lip 112 and changes a tension force, the bucking lip tension, on the BB 110 being chambered in the rubber bucking 102.

The tension adjustment sleeve 114 and tension adjustment screw 116 are hollow so that the air nozzle can pass through to position the BB in the tapered end or bucking lips 112 of the rubber bucking 102. The tension adjustment sleeve 114 is formed of a resilient material that is housed to allow axial movement of the sleeve. By tightening the tension adjustment screw 116 to cause the tension adjustment sleeve 114 to compress against the bucking lips 112, the hollow diameter through the tension adjustment sleeve 114 is reduced, causing more force to be needed to seat the BB 110 in the rubber bucking 102. Conversely, by loosening the tension adjustment screw 116 and therefore relaxing the tension adjustment sleeve 114 from against the rubber bucking 102, the BB 110 is able to be moved through and seated in the rubber bucking 102 more easily.

As seen in FIGS. 2-4, the tension adjustment screw 116 in FIG. 1 may be arranged as a hollow body that is threaded on an outer perimeter, and configured to be rotated, and thus moved axially, by a threaded dial 118. The dial 118 may have numbers or other indicia provided on a surface for a user to conveniently dial a desired level of tension on the tension adjustment sleeve 114 in FIG. 1.

In FIG. 1, the tension adjustment screw 116 may be arranged immediately behind the tension adjustment sleeve 114, and may be arranged such that the tension adjustment sleeve 114 is not twisted when compressed or relaxed. The interface between the tension adjustment screw 116 and the tension adjustment sleeve 114 may treated to reduce or eliminate such a twisting friction. In addition, an intermediate material may be provided between the tension adjustment screw 116 and the tension adjustment sleeve 114.

The tension adjustment sleeve 114 may be configured to envelop the tapered end or bucking lip 112 of the rubber bucking 102. The tension adjustment sleeve 114 forms an opening at the bottom to allow BBs to pass from the magazine to be chambered. By moving the tension adjustment sleeve 114 axially, with a front end of the tension adjustment sleeve 114 fixed at the tapered end or bucking lip 112 of the rubber bucking 102, the tension adjustment sleeve 114 can be adjusted to provide a desired amount of tension on the BB 110 being chambered, to tune the chambering process to the rubber bucking 102 in the hop-up device or system 110. By compressing the tension adjustment sleeve 114, the tension adjustment sleeve 114 provides more pressure on the BB 110, and by relaxing the tension adjustment sleeve 114, the tension adjustment sleeve 114 provides less pressure on the BB 110.

The hop-up device or system for an airsoft gun may include a rubber bucking 102 configured for a BB 110 to travel through into a barrel 104, a mechanism for adjusting the engagement of a hop nub 108 into a top portion of the rubber bucking 102 to place a backspin on the BB 110 traveling through into a barrel 104, and a tension adjustment sleeve 114 provided adjacent a proximal end or bucking lip 112 of the rubber bucking 102 and configured to apply a desired tension on a BB 110 being positioned to enter the rubber bucking 102. The tension adjustment sleeve 114 may share a longitudinal axis with the rubber bucking 102. The tension adjustment sleeve 114 may rest against an inner chamber of the hop-up device or system 100 at a lowest tension, and gradually decreases in diameter as tension is increased. The tension adjustment sleeve 114 may be configured to compress axially to decrease an inner diameter in order to increase the tension. The hop-up device or system 100 may further include a tension adjustment screw 116 provided at a back end of the tension adjustment sleeve 114, and configured to axially compress the tension adjustment sleeve 114 when turned in a first direction, and to relax the tension adjustment sleeve 114 when turned in a second direction. The rubber bucking 102 may have a tapered proximal end or bucking lip 112, and the tension adjustment sleeve 114 may be configured to fit around the tapered proximal end or bucking lip 112 to prevent loss of compressed air applied to a BB 110 entering the rubber bucking 102. The tension adjustment sleeve 114 may form an opening at a lower portion configured to allow a BB 110 to pass from a loading magazine into the tension adjustment sleeve 114.

FIG. 5 represents a disassembled view an airsoft gun system 200 with the hop-up device or system 100 that allows the assembly of airsoft guns having optional configurations. The hop-up device or system 100 is connected to the end of barrel 104 as previously discussed, which are disposed in a lower receiver 250 with one of the optional cylinders or engines 252 connected to the hop-up device or system 100. A magazine 254 is connected to the lower receiver 250 and feeds BBs to the hop-up device or system 100. The cylinder or engine 252 is connected to one of the optional stock buffer tubes 260 that are disposed inside a stock 262. An optional stock 264 may be used. An upper receiver with rail 256 is connected to the lower receiver 250 with pins (not shown) with the barrel 104 extending through the upper receiver with rail 256. Optional barrels 266 may be used in place of barrel 104. Optional rails 258 may be used in place of the rail in the upper receiver with rail 256. The airsoft gun system 200 provides an airsoft gun with the hop-up device or system 100 that allows a user to adjust the tension applied to a BB during the chambering of the BB in the airsoft gun as previously discussed. The hop-up device or system 100 may be disposed in airsoft guns having other configurations and other or additional components.

Unless otherwise indicated, all numbers expressing quantities and properties such as amounts, distances, and the like used in the specification and claims are to be understood as indicating both the exact values as shown and as being modified by the term "about". Thus, unless indicated to the contrary, the numerical values of the specification and claims are approximations that may vary depending on the desired properties sought to be obtained and the margin of error in determining the values. At the very least, and not as an attempt to limit the application of the doctrine of equivalents to the scope of the claims, each numerical parameter should at least be construed in light of the margin of error, the number of reported significant digits, and by applying ordinary rounding techniques.

The terms "a", "an", and "the" used in the specification claims are to be construed to cover both the singular and the plural, unless otherwise indicated or contradicted by context. No language in the specification should be construed as indicating any non-claimed element to be essential to the practice of the invention.

Note that spatially relative terms, such as "up," "down," "right," "left," "beneath," "below," "lower," "above," "upper" and the like, may be used for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors interpreted accordingly.

This detailed description provides an understanding of the structures and fabrication techniques described of the hop-up device or system for use in airsoft guns. The simplified diagrams and drawings do not illustrate all the various connections and assemblies of the various components; however, those skilled in the art will understand how to implement such connections and assemblies based on the illustrated components, figures, and provided descriptions. The description of well-known functions and constructions may be simplified and/or omitted for increased clarity and conciseness. While various aspects of the hop-up device or system are described, it will be apparent to those of ordinary skill in the art that other embodiments and implementations are possible within the scope of the invention. Accordingly, the hop-up device or system is not to be restricted except in light of the attached claims and their equivalents.

The invention claimed is:

1. A hop-up system for an airsoft gun, the system comprising:

a rubber bucking forming a hollow core with a diameter for a BB to travel through, the rubber bucking having a bucking lip;

a hop nub protruding into a top portion of the rubber bucking, the hop nub disposed to engage the top of the BB when traveling through the hollow core;

a tension adjustment sleeve axially situated adjacent to the bucking lip, the tension adjustment sleeve operatively disposed to apply a desired tension on a BB when the BB is loaded against the bucking lip;

a tension adjustment screw disposed adjacent to the tension adjustment sleeve, the tension adjustment screw being repositionable between at least two axial locations, where the tension adjustment screw applies a pressure to the tension adjustment sleeve at each axial location, where the pressure is different at each axial location; and the tension adjustment sleeve applying a different desired tension to the BB when the tension adjustment screw is at a different axial location.

2. The hop-up system of claim 1, where the tension adjustment sleeve applies a lower tension to the BB when the tension adjustment screw is repositioned to an axial location farther away from the bucking lip, and where the tension adjustment sleeve applies a higher tension to the BB when the tension adjustment screw is repositioned to an axial location closer to the bucking lip.

3. The hop-up system of claim 1, the tension adjustment screw being repositionable between twelve axial locations.

4. The hop-up system of claim 1, wherein the tension adjustment screw axially compresses the tension adjustment sleeve when the tension adjustment screw is turned in a first direction, and where the tension adjustment screw axially relaxes the tension adjustment sleeve when the tension adjustment screw is turned in a second direction.

5. The hop-up system of claim 1, where the tension adjustment sleeve envelops the bucking lip to prevent loss of compressed air applied to a BB entering the rubber bucking.

* * * * *